US007455025B1

(12) United States Patent
Franta

(10) Patent No.: US 7,455,025 B1
(45) Date of Patent: Nov. 25, 2008

(54) BRIDAL PLATE FOR MOORING

(76) Inventor: John Eugene Franta, 3055 N. Reel Mountain #95, Mesa, AZ (US) 85207

( * ) Notice: Subject to any disclaimer, the term of this patent is extended or adjusted under 35 U.S.C. 154(b) by 0 days.

(21) Appl. No.: 11/890,143

(22) Filed: Aug. 3, 2007

Related U.S. Application Data

(60) Provisional application No. 60/852,104, filed on Oct. 17, 2006, provisional application No. 60/835,188, filed on Aug. 3, 2006.

(51) Int. Cl.
*B63B 21/00* (2006.01)

(52) U.S. Cl. ..... 114/230.26; 114/230.2

(58) Field of Classification Search ..... 114/230.1, 114/230.2, 230.26, 230.3; 441/3, 5
See application file for complete search history.

(56) References Cited

U.S. PATENT DOCUMENTS 653,021 A 7/1900 Hamilton
1,801,729 A 4/1931 Elliott
1,828,821 A 10/1931 Short et al.
3,077,614 A 2/1963 Lloyd
3,082,439 A 3/1963 Hornbostel et al.
3,103,020 A 9/1963 Bolton
3,641,602 A 2/1972 Flory et al.
4,281,612 A 8/1981 Watts
4,529,388 A 7/1985 Jones et al.
6,357,378 B1 * 3/2002 Hile ..... 114/230.2
6,439,149 B1 * 8/2002 Hile ..... 114/230.1
6,488,554 B2 12/2002 Walker

* cited by examiner

*Primary Examiner*—Lars A Olson
(74) *Attorney, Agent, or Firm*—Ronald R. Kilponen

(57) ABSTRACT

A bridal plate is shown and disclosed where the bridal plate is secured to a mooring ball or other static object with a jaw. The bridal plate has a plurality of shackles attached to the plate and lines are attached to the shackles. The lines are then secured to the boat or floating object. This allows multiple lines between the floating object and static object and reduces the possibility of the lines crossing and chafing of lines against one another helping to prevent premature failure of the lines or connectors.

13 Claims, 7 Drawing Sheets

BRIDAL PLATE FOR MOORING

CROSS REFERENCE TO RELATED APPLICATIONS

This application claims the benefit of Provisional application for Patent Ser. No. 60/852,104 filed on Oct. 17, 2006 and Provisional application for Patent Ser. No. 60/835,188 filed on Aug. 3, 2006.

FIELD

The present version of this invention relates generally to the field of devices used to moor ships or boats to moorings.

BACKGROUND

This invention relates to devices for securing boats and ships to moorings, and more particularly to a device which allows the user to secure multiple lines from the mooring to the boat or ship.

Many persons who have boats or ships tie them up to a mooring near shore or in a harbor. A mooring is a floating device anchored to the shore or bottom of the harbor. A mooring is intended to secure the boat or ship so that the boater is not required to launch and remove a boat or ship from land and water each time it is used.

In areas where there can be storms or rough seas, boaters many times use more than one line to secure the boat or ship to the mooring. The use of multiple lines can help secure the boat to the mooring so that strong winds and waves do not tear the boat from the mooring often having catastrophic effects and many times resulting in the entire loss of the boat or ship. Multiple line attachment methods suffer from some significant disadvantages.

The background art shows that attaching a boat, ship or vehicle to a mooring was either done with a single line or with redundant lines. A common method for redundant lines was accomplished by placing the multiple lines on a common ring of the mooring. The lines are attached to a thimble and this thimble is then attached to the ring or chain of the mooring. There are significant disadvantages to the method shown in the background art.

This background art method causes interference or cross over of the thimbles and can cause excess abrasion of the lines often leading to premature failure from abrasion of the thimbles, lines or both.

The method shown in the background art does not allow for the even distribution of load between the lines. In order to get even loading of the lines they would need to have the same distance between the ring on the mooring and where they are tied off on the boat, or ship. This is extremely difficult to do, to get a common line distance. This is due to the rolling of the boat or ship relative to the mooring. Because the ship or boat is rolling in the water, the line distances are rarely the same resulting in uneven loading of the lines between the mooring and the boat or ship.

When the thimbles from, for example three lines, are attached to the ring on the mooring, they rest next to each other. Because the ring on the mooring is generally on the top of the mooring, the thimbles are not the same distance from the boat or ship. This also contributes to the unequal length of the mooring ropes shown in the background art.

For the foregoing reasons, there is a need for a bridal plate that can hold redundant mooring lines from a mooring.

SUMMARY

In view of the foregoing disadvantages inherent in the background art for mooring or attaching boats or ships to a mooring there is a need for a bridal plate that can accommodate redundant lines and that minimizes many of the shortcomings of the methods or products used in the background art.

A first objective is to provide a device that can help secure boats or ships to a mooring.

Another objective is to provide a device that can help eliminate premature failure of mooring lines and attachments.

It is yet another objective to provide a device that can help even out the tension on each of the mooring lines.

It is a still further objective to allow the use of redundant mooring lines from the mooring to the ship or boat.

These together with other objectives, along with various features of novelty which characterize these embodiments, are pointed out with particularity in the claims annexed hereto and forming a part of this disclosure. For a better understanding of these embodiments, the operating advantages and the specific goals attained by its uses, reference should be had to the accompanying drawings and descriptive matter in which there is illustrated several embodiments.

DETAILED DESCRIPTION OF THE PREFERRED EMBODIMENTS

Figure 1:
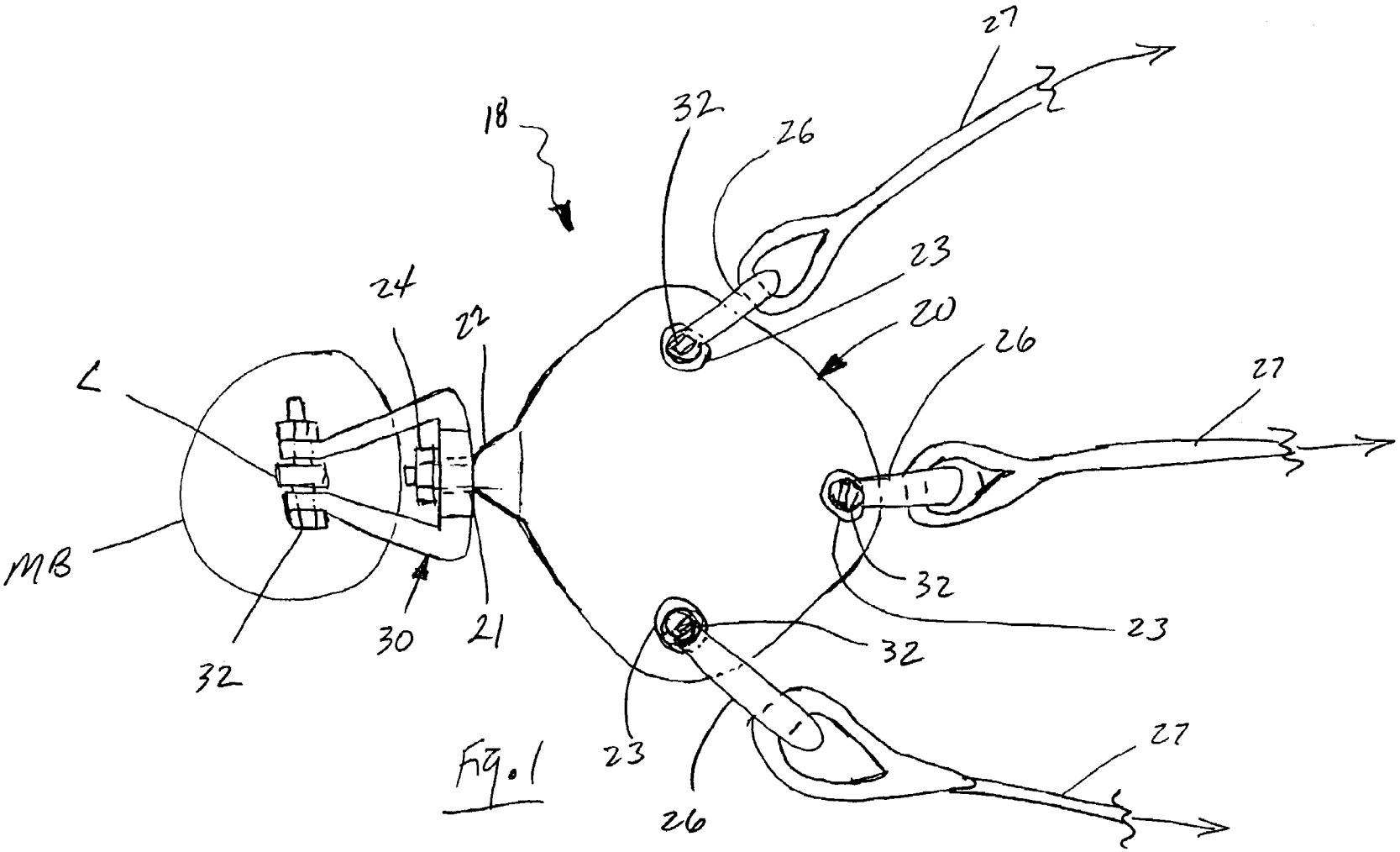
FIG. 1 shows a top view of one embodiment of the device attached to a mooring ball.

Referring to the drawings in detail wherein like elements are indicated by like numerals, there is shown in FIG. 1 a bridal plate 18. The bridal plate 18 is assembled from a plate 20 and a jaw 30. The jaw 30 has a stem hole 21 through which is inserted the stem 22 of the plate 20. The stem 22 is threaded to accommodate a nut 24. The plate 20 and jaw 30 are retained together with nut 24. The plate 20 can be made from a plate steel either a stainless steel or a carbon steel which is then treated to prevent rust and corrosion. It should be understood that various shapes to the plate 20 could be manufactured.

The stem 22 allows the plate 20 to rotate relative to the jaw 30 thus the jaw 30 acts as a swivel. This swivel action of the plate 20 allows the lines 27 to rotate relative to the mooring ball MB and lessens the likelihood of line on line contact which cause accelerated wear and eventual failure of the lines 27.

It should also be recognized that the shackles 26 affixed to the plate 20 also allow movement of the lines 27 relative to the plate 20 both horizontally and vertically. This relative movement of the lines 27 helps prevent crossover of the lines and can result in less friction and wear. The arrangement of the lines 27 also allows for more even loading of the lines 27 and hence the lines should last longer due to the lessened focused single line loading that can occur on much of the background art. This more even loading also benefits the attachment of the lines at the other end also. Obviously less focused loading on a single line lessens the chances for failure at the object being tied.

Figure 2:
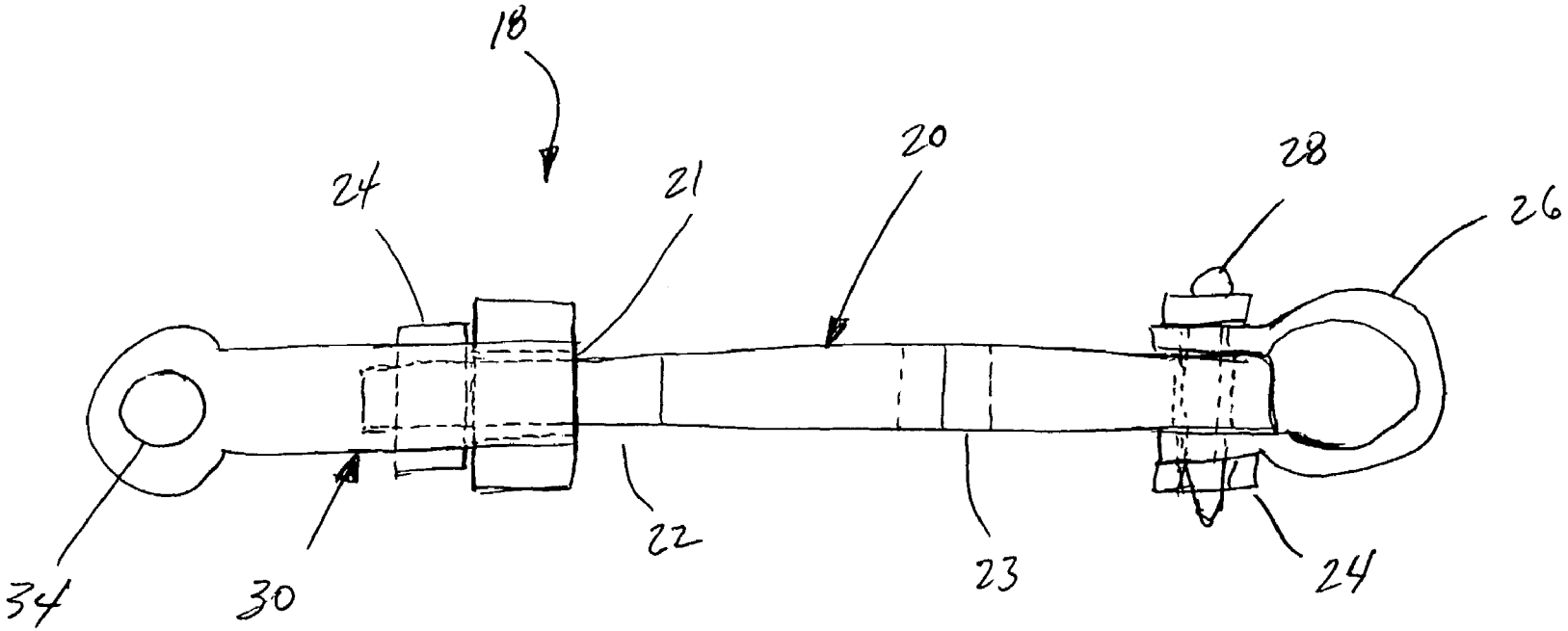
FIG. 2 shows a side view of one embodiment of the device.
Figure 3:
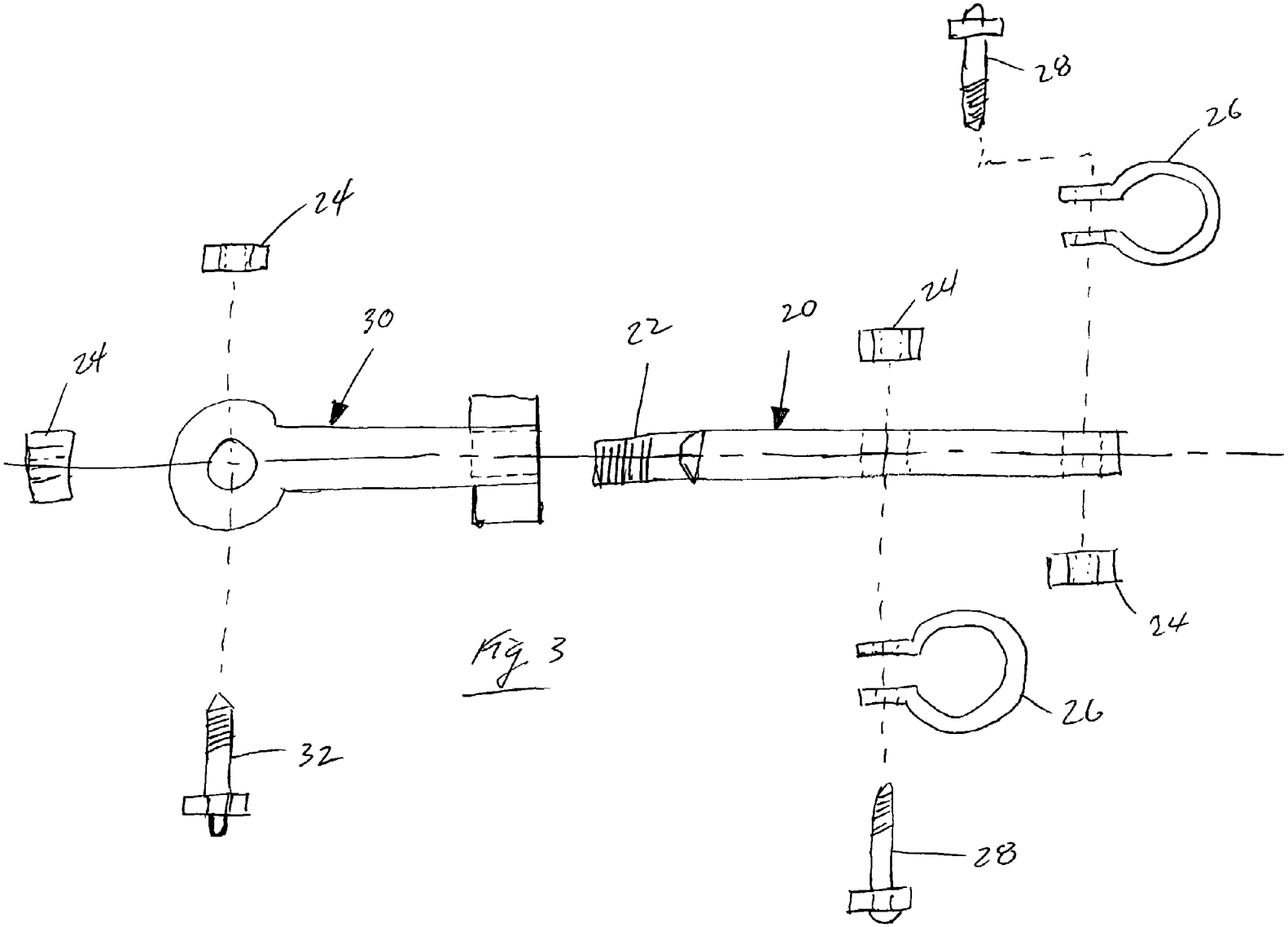
FIG. 3 shows an exploded view of some of the elements of one embodiment of the device.

On the plate 20 are a plurality of line holes 23, this embodiment shows three line holes 23. The line holes 23 are all parallel to one another and perpendicular to the plate 20. Shackles 26 are attached to the plate 20 through the line holes 23 with swivel pins 28 and nuts 24 (See FIG. 2). The shackles 26 are then attached to lines 27. The lines 27 are affixed to the boat or floating item. It should be understood that fewer line holes 23 could be arranged such that there are only two lines 27 extending and tied off at the vessel. Even the two line embodiment of plate 20 allows an extra line to the vessel or device being secured as compared to much of the background art which only has one line A pin 32 is used to attach the jaw 30 to a link of chain L which in turn is secured to a mooring ball MB, FIG. 1. While this embodiment shows the jaw 30 attached to the link L which is positioned above the mooring ball MB, it should be understood that the jaw 30 could also be attached to the link L below the mooring ball MB, not shown. The pin 32 may be attached below the mooring ball MB to link L if the mooring ball MV is small in size or if there are no links L on top of the mooring ball MB.

Figure 4:
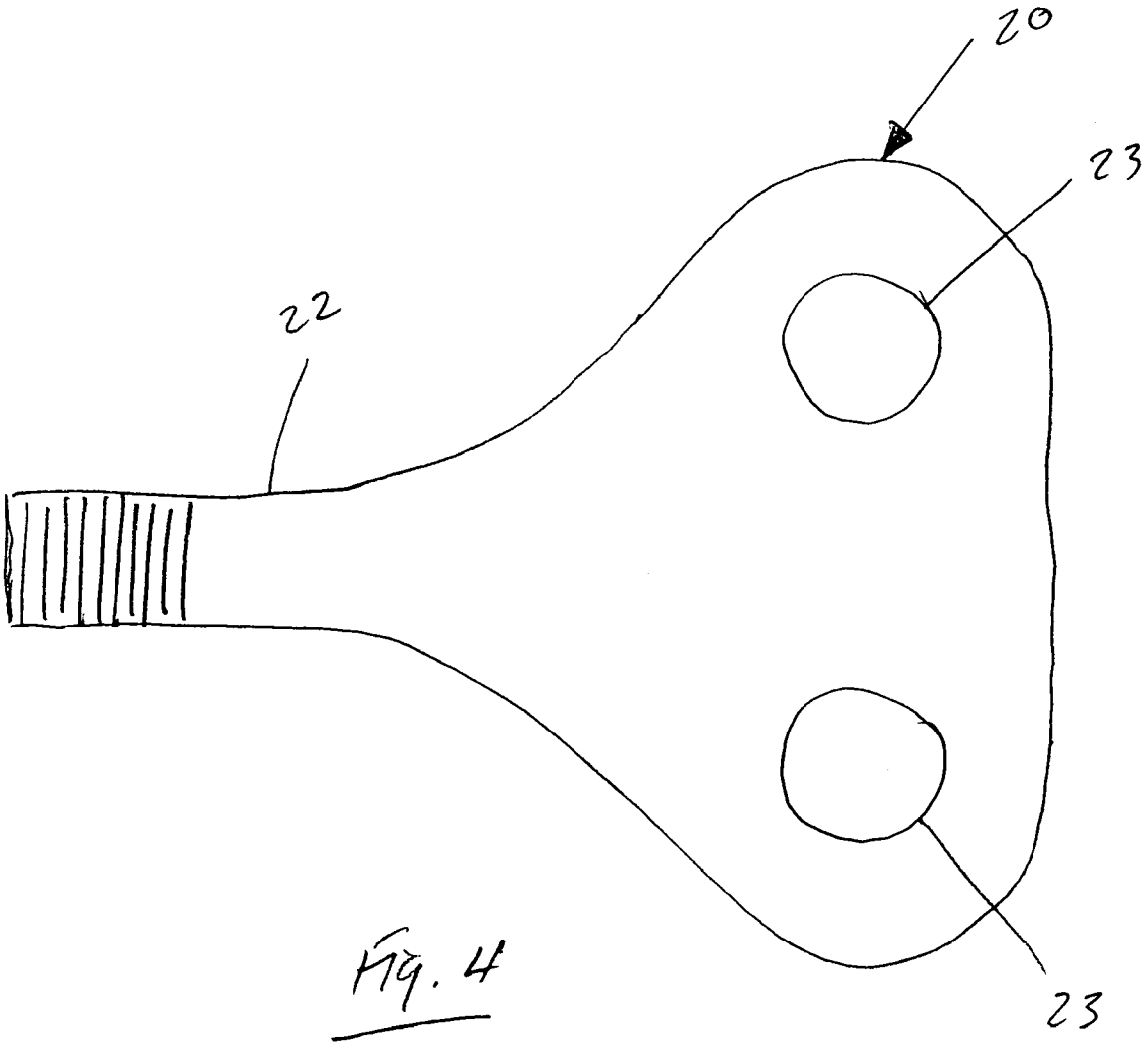
FIG. 4 shows an alternative embodiment of the plate with two line holes.

FIG. 4 shows an alternative embodiment of the plate 20. In this embodiment, the plate 20 has two line holes 23. The line holes 23 are also separated which helps prevent line 27 crossover, friction and premature wear. This plate 20 can be used on a mono-hull vessel with one line 27 affixed to each side of the hull. The embodiment of the plate 20 shown in FIG. 1, where there are three lines 27 can be used on multi hull vessels such as catamarans and tri-marans or it could also be used on a mono hull vessels with the third line used as added protection.

Figure 5:
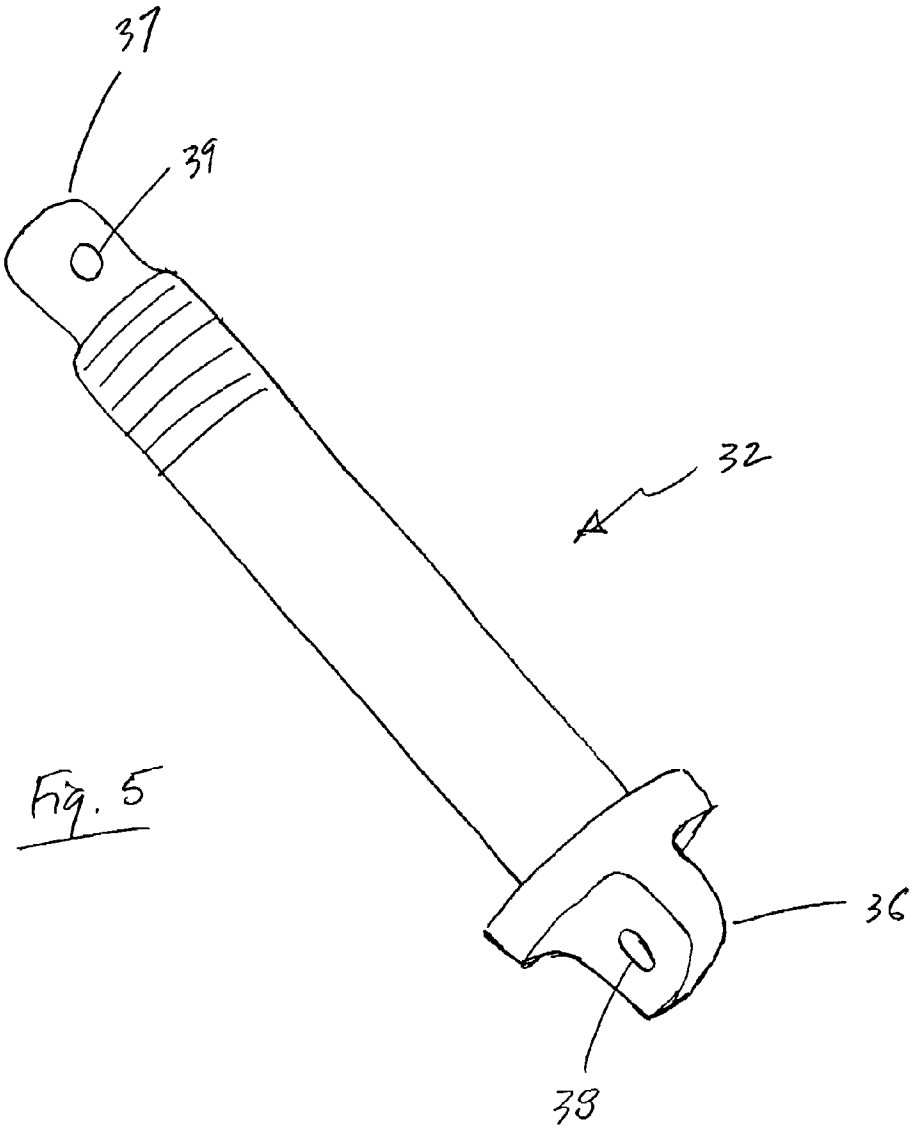
FIG. 5 shows an alternative embodiment of the pin or swivel pin.

FIG. 5 shows an alternative embodiment of the pin 32 or swivel pin 28. In this embodiment, pin 32 has a head 36 and a toe 37. Near the head 36 is located a head hole 38 and near the toe 37 is located a toe hole 39. The head hole 38 and toe hole 39 can be used to wire these elements to surrounding elements to help prevent their loss as is known in the art. Toe hole 39 can also be used for a cotter pin, not shown. These head holes 38 and toe holes 39 in this embodiment of the pin 32 provides an additional measure of safety in that cotter pins or wiring can help prevent the nuts 24 and pins 28, 32 form loosening or falling out.

Figure 6:
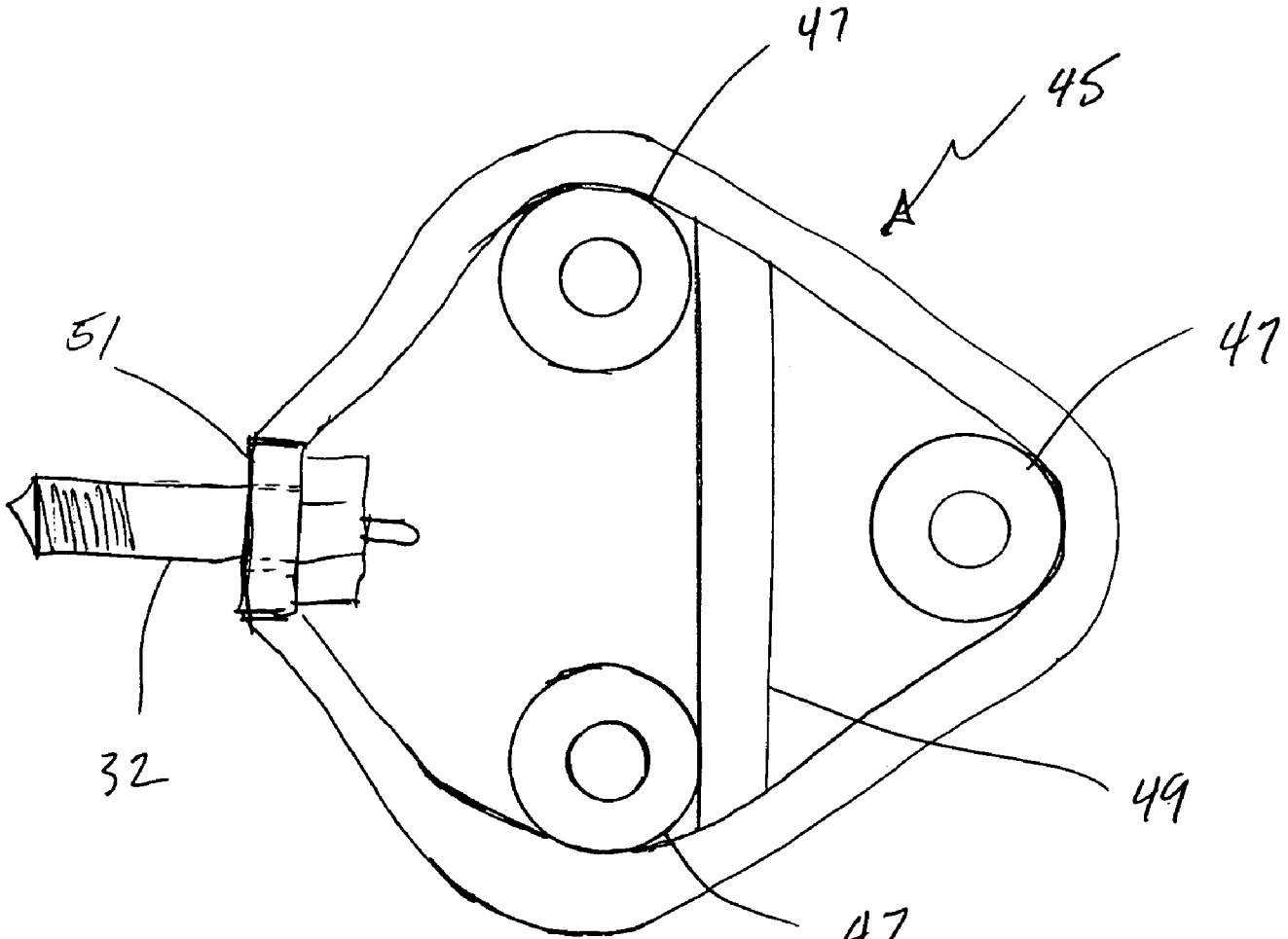
FIG. 6 shows an alternative embodiment of the plate.

FIG. 6 shows an alternative embodiment of the plate 45. In this embodiment the plate 45 is manufactured from a metal rod and bent and welded to form the formed plate 45. Circular shaped shackle disks 47 are welded to the inside of plate 45 and a circular stem disk 51 for housing pin 32. Pin 32 is then affixed to the jaw 30 (not shown). Shackles are then retained by the shackle disks 47. It should be understood that while this embodiment of the plate 45 shows three shackle disks 47, there could be only two shackle disks 47.

This embodiment of the plate 45 could also have one or more cross members 49 to help strengthen the plate 45. This embodiment of the plate 45 would be lighter than the previous embodiment and may be useful for those applications that are used on smaller boats or ships. It may also be more useful on smaller mooring balls MB that are less able to retain buoyancy for the other disclosed embodiments.

Figure 7:
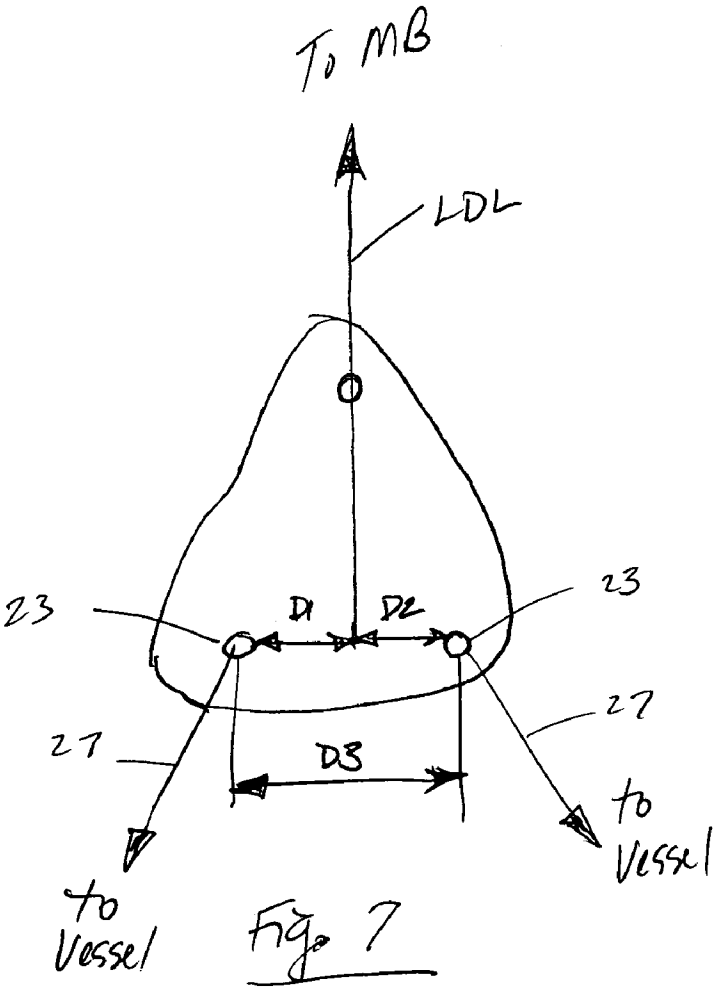
FIG. 7 shows a schematic of relative distances of the line holes from the load line.

FIG. 7 illustrates that the line holes 23 are equidistance D1 and D2 from the load line LDL which runs to the mooring ball MB. D3 is a predefined distance such that the shackles 26 will not interfere with one another causing wear and premature failure.

Figure 8:
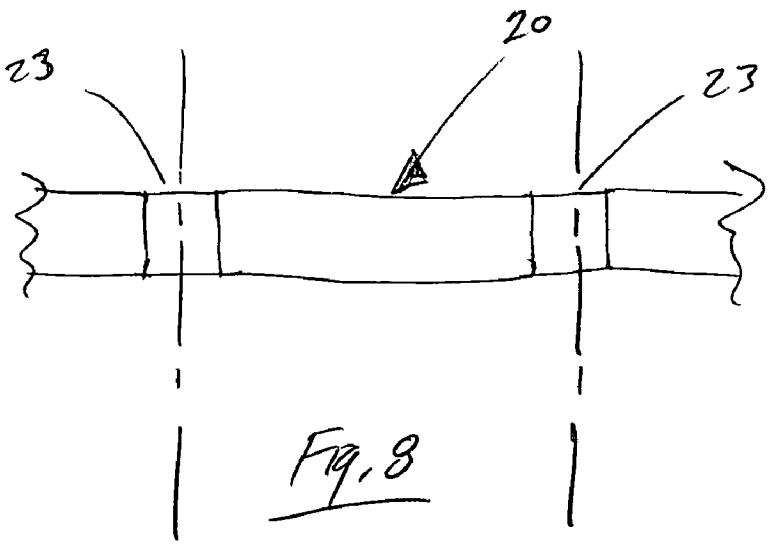
FIG. 8 shows that the line holes are parallel to one another.

FIG. 8 shows that the line holes 23 are all parallel to one another.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

The invention claimed is:

1. A device for mooring floating vessels to a mooring ball or fixed object, the device comprising:

a plate, the plate having a plurality of line holes near one end and a stem near the other end, the line holes parallel to one another;

a plurality of shackles, one attached in each of the line holes, the shackles attached with a pin and a nut;

a jaw attached to the stem of the plate with a nut, the jaw having a pin, the pin used to secure the jaw to a fixed object with a nut;

each shackle attached to a line, the line attached to the floating vessel; and whereby the plate swivels around the jaw, the shackles swivel relative to the plate and the lines have movement relative to the shackles thereby helping to prevent line crossover and premature failure of the lines.

2. The pins of claim 1 further comprising:

the pin having a head hole near the head of the pin and a toe hole near the other end of the pin, the head hole for receiving wire to secure the pin and the toe hole for receiving wire to secure the nut to the pin.

3. The pins of claim 1 further comprising:

the pin having a head hole near the head of the pin and a toe hole near the other end of the pin, the head hole for receiving wire to secure the pin and the toe hole for receiving a cotter pin to secure the nut to the pin.

4. The line holes of claim 1 wherein:

the number of line holes is three.

5. The shackles of claim 1 wherein:

the number of shackles is three.

6. The line holes of claim 1 wherein:

the number of line holes is two.

7. The shackles of claim 1 wherein:

the number of shackles is two.

8. A device for securing floating objects to a mooring ball or fixed object, the device comprising:

a flat plate, the plate having a threaded stem on one end and a plurality of line holes on an opposite end, the line holes located parallel to one another and perpendicular to the stem;

a jaw, the jaw attached to the stem with a nut such that the plate can rotate relative to the jaw, the jaw having a pin for securing the jaw to a fixed object, the pin secured with a nut;

a plurality of shackles affixed one to each of the line holes, the shackles secured to the line holes with a pin and nut, the shackles affixed to lines, the lines secured to the floating object; and the pins having a toe hole for receiving a cotter pin to secure the nut to the pin and a head hole for receiving wire to secure the pin.

9. The line holes of claim 8 wherein:

the number of line holes is three.

10. The shackles of claim 8 wherein:

the number of shackles matches the number of line holes.

11. The line holes of claim 8 wherein:

the number of line holes is two.

12. The toe holes of the pins of claim 8 further comprising:

wire is inserted into the toe holes to secure the nuts to the pins.

13. A device for securing vessels to a mooring ball or other fixed element, the device comprising:

a jaw, the jaw attached to the fixed element with a pin, the pin secured to the jaw with a nut, the pin having a head hole for receiving wire to secure the pin to the jaw, the pin having a toe hole for receiving wire to secure the nut to the pin, the jaw attached to a stem with a nut;

the stem located on one end of a plate, the plate having a plurality of line holes in the plate opposite the stem, the line holes parallel to one another and perpendicular to the stem;

one shackle secured to each of the line holes with a pin and nut;

a line secured to each shackle and running to the vessel to secure the vessel to the fixed element; and whereby the plate rotates relative to the jaw, the shackles rotate relative to the plate, and the lines move both horizontally and vertically relative to the shackles.

* * * * *